US007086666B2

(12) United States Patent
Richardson

(10) Patent No.: US 7,086,666 B2
(45) **Date of Patent: *Aug. 8, 2006**

(54) IDENTIFICATION CARD WITH EMBEDDED HALFTONE IMAGE SECURITY FEATURE PERCEPTIBLE IN TRANSMITTED LIGHT

(75) Inventor: Jack T. Richardson, Lyman, ME (US)

(73) Assignee: Digimarc Corporation, Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/870,678

(22) Filed: Jun. 16, 2004

(65) Prior Publication Data

US 2005/0035589 A1 Feb. 17, 2005

Related U.S. Application Data

(63) Continuation of application No. 09/602,313, filed on Jun. 23, 2000, now Pat. No. 6,752,432.

(60) Provisional application No. 60/140,611, filed on Jun. 23, 1999.

(51) Int. Cl.
*B42D 15/00* (2006.01)

(52) U.S. Cl. ..... 283/91; 283/67; 283/81; 283/86; 283/94; 283/98; 283/101; 283/105; 283/108; 283/110; 428/13; 428/131; 428/137; 428/201; 428/203; 40/299.01

(58) Field of Classification Search ..... 283/67, 283/81, 86, 91, 94, 98, 101, 105, 108, 110; 428/13, 131, 137, 201, 203; 40/299.01
See application file for complete search history.

(56) References Cited

U.S. PATENT DOCUMENTS 3,413,171 A 11/1968 Hannon
3,571,957 A * 3/1971 Cumming et al. ..... 283/70
3,582,439 A 6/1971 Thomas
3,601,913 A * 8/1971 Pollock ..... 283/82
3,614,839 A 10/1971 Thomas
3,647,275 A * 3/1972 Ward ..... 380/54
3,802,101 A * 4/1974 Scantlin ..... 283/87
4,069,487 A * 1/1978 Kasai et al. ..... 346/135.1
4,096,015 A 6/1978 Kawamata et al.
4,119,361 A * 10/1978 Greenaway ..... 283/88
4,304,809 A 12/1981 Moraw et al.
4,313,984 A * 2/1982 Moraw et al. ..... 428/13
4,324,421 A * 4/1982 Moraw et al. ..... 283/75

(Continued)

FOREIGN PATENT DOCUMENTS

WO WO98/19869 5/1998

(Continued)

*Primary Examiner*—Boyer Ashley
*Assistant Examiner*—Mark Henderson
(74) *Attorney, Agent, or Firm*—Digimarc Corporation

(57) ABSTRACT

An information-bearing laminar assembly, suitable for use as an identification card, is disclosed. The assembly is characterized by the provision therein of an embedded halftone image security feature that becomes visible essentially only when the assembly is view in transmitted light. The information-bearing laminar assembly comprises an inner information-bearing layer interposed between a first and a second light-transmissive protective outer layer. The inner layer contains both visible information-bearing indicia and an imagewise halftone pattern of laser-ablated microholes. The light-transmissivity of the information-bearing inner layer within said half-tone pattern is imagewise differentiated at each microhole as a function of the microhole's penetration depth. Sandwiched between the protective outer layers, the halftone pattern is imperceptible when the information-bearing laminar assembly is viewed in reflections and perceptible when the information-bearing laminar assembly is viewed in transmission.

30 Claims, 3 Drawing Sheets

U.S. PATENT DOCUMENTS 4,356,052 A 10/1982 Moraw et al.
4,568,824 A * 2/1986 Gareis et al. ..... 235/487
4,579,754 A * 4/1986 Maurer et al. ..... 428/29
4,711,690 A 12/1987 Haghiri-Tehrani
4,766,026 A 8/1988 Lass et al.
4,889,749 A 12/1989 Ohashi et al.
4,968,063 A 11/1990 McConville et al.
5,060,981 A 10/1991 Fossum et al.
5,128,779 A 7/1992 Mallik
5,169,707 A 12/1992 Faykish et al.
5,216,543 A * 6/1993 Calhoun ..... 359/619
5,393,099 A 2/1995 D'Amato
5,449,200 A 9/1995 Andric et al.
5,454,598 A 10/1995 Wicker
5,550,346 A 8/1996 Andriash et al.
5,700,037 A * 12/1997 Keller ..... 283/107
6,302,444 B1 10/2001 Cobben
6,752,432 B1 * 6/2004 Richardson ..... 283/91
2002/0027359 A1 3/2002 Cobben et al.

FOREIGN PATENT DOCUMENTS

WO WO00/43216 7/2000

* cited by examiner

IDENTIFICATION CARD WITH EMBEDDED HALFTONE IMAGE SECURITY FEATURE PERCEPTIBLE IN TRANSMITTED LIGHT

REFERENCE TO RELATED APPLICATIONS

This application is a continuation of allowed U.S. appn. Ser. No. 09/602,313, filed Jun. 23, 2000 (to issue Jun. 22, 2004 as U.S. Pat. No. 6,752,432). Application Ser. No. 09/602,313 claims benefit of Provisional U.S. Pat. Appn. Ser. No. 60/140,611, filed Jun. 23, 1999.

FIELD

The present invention relates in general to an information-bearing laminar assembly suitable for use as an identification card, and more particularly, to an information-bearing laminar assembly having embedded therein a halftone image security feature that is perceptible essentially only in transmitted light.

BACKGROUND

Many types of personal information-bearing cards and documents—such as state drivers licenses, voter registration cards, passports, bank cards, credit cards, and certain key-cards and so-called "smart cards"—almost invariably include on an information-bearing surface thereof items of information relating to the identity of the card's authorized holder. Items of personal information commonly included are the authorized holder's name, address, birth date, signature, and a photographic image of the holder. Although such information can be recorded in encoded machine-readable format (e.g., on a magnetic stripe), almost invariably, at least one item of personal information will be provided either textually or graphically (i.e., as visually-perceptible indicia).

As is well-known, the principal purpose of including personal information on an information-bearing card or document is to both enable and facilitate personal identification. However, as is also well-known, these functions can be undermined if the card or document is easily counterfeited or fraudulently altered.

Thus, in many instances, it is highly desirable that once information is placed onto to the image-bearing surface, the surface be treated in such a manner as to render it difficult or impossible to mechanically alter or amend, at least without rendering it clearly obvious that some tampering with the surface has taken place. To this end, numerous types of laminations have been employed in which the information-bearing surface is heat or solvent-laminated to a transparent surface. The materials for and the process of lamination are selected such that if an attempt is made to uncover the information-bearing surface for amendment thereof, the surface is destroyed, defaced or otherwise rendered apparent the attempted intrusion.

While an identification card that essentially cannot be disassembled without being destroyed may provide suitable resistance against fraudulent alteration, such will not significantly challenge attempts of counterfeiting.

The counterfeiting of identification cards involving as it does the fabrication and issuance of identification cards by persons not authorized to do so presents additional and different security problems to the art. Perhaps the most effective way of preventing counterfeiting would involve strict control over the possession of the materials and equipment involved in the fabrication of the identification card. In most cases, however, this approach would be impractical and most likely impossible. For example, too many of the materials involved are commercially available and used in other applications. Instead, the art's response to the counterfeiting problem has involved the integration of verification features that are difficult to copy by hand or by machine. The best known of such verification features is the use in the card of a signature of the card's issuer or bearer. Other verification features have involved, for example, the use watermarks, microprinting, fluorescent materials, fine line details, validation patterns or marking, and polarizing stripes. These verification features are integrated into an identification card in various ways and they may be visible or invisible in the finished card. If invisible, they can be detected by viewing the feature under conditions which render it visible.

All of the verification features discussed above have achieved a measure or success in preventing or discouraging counterfeiting. However, in certain respects, some features are considered to fall short in terms of the idealized performance characteristics desired. In particular, many of the features are expensive and, in the case of features hidden from casual visual inspection, require specialized equipment and trained operator for authentication.

In consideration of the above, a need was felt to include in an information bearing card or document, a novel and unique security feature that would be difficult to reproduce either in a counterfeited document or by the fraudulent alteration of an original, but would for authentication require neither specialized equipment nor trained operators.

SUMMARY

In light of the above need, the present invention provides—as it's most preferred embodiment—an identification card with an embedded halftone image security feature that is perceptible essentially only by the transmitting light therethrough. The structure of such identification card can be defined as an information-bearing laminar assembly that comprises an information-bearing inner layer interposed between first and second light-transmissive protective outer layers. The information-bearing inner layer has both visually-perceptible information-bearing indicia on a surface thereof and an imagewise halftone pattern of laser-ablated microholes. Each laser-ablated microhole penetrates either completely through the thickness of the inner information-bearing layer or a portion thereof such that the light-transmissivity of the information-bearing inner layer within said half-tone pattern is imagewise differentiated at each microhole.

Central to and in accordance with the invention, the first and second light-transmissive protective outer layers are configured and cover said half-tone pattern of laser-ablated microholes such that, under unassisted visual inspection, the imagewise halftone pattern is (a) substantially imperceptible when the information-bearing laminar assembly is viewed in reflection, and (b) substantially perceptible when the information-bearing laminar assembly is viewed in transmission.

In a product embodiment of the invention, the information-bearing laminar assembly is provided further with destructible peripheral perforations correspondent with the periphery of the information-bearing inner layer. The perforations are configured to fracture if an attempt is made to delaminate the information-bearing laminar assembly, and thus, provides a good positive indicator of a possible occurrence of such security-compromising activity.

In a method embodiment of the invention, there is also described herein a process for manufacturing the inventive information-bearing laminar assembly. The method is characterized by the use of laser ablation technology to provide the assembly's imagewise halftone pattern of laser-ablated microholes. During ablation, the intensity and duration of the laser irradiation is modulated to imagewise differentiate the penetration depths of said microholes into said polymeric planar material.

In light of the above, it is a principal object of the present invention to provide an information-bearing laminar assembly having embedded therein a halftone image security feature that is perceptible essentially only in transmitted light, wherein the halftone image security feature is an imagewise halftone pattern of laser ablated microholes.

It is another object of the present invention to provide an identification card having an embedded halftone image security feature that can be relatively inexpensive and easy to provide therein, and thus suitable for incorporation into commercial identification card product lines having relatively broad expected user distribution.

It is another object of the invention to provide a method of manufacturing the information-bearing laminar assembly.

It is another object of the present invention to provide means for detecting whether said information-bearing laminar assembly had been delaminated and subsequently relaminated.

It is another object of the present invention to provide an information-bearing laminar assembly, suitable for use as an identification card, that employs a security feature, the authentication of which requires no specialized equipment.

It is another object of the present invention to provide an information-bearing laminar assembly, suitable for use as an identification card, that employs a security feature that is resistant to photocopying or scanning.

These and other advantages of the invention, as well as details relating to the practice of the invention, will be better appreciated from the following detailed description construed with consideration of the attached drawings.

DETAILED DESCRIPTION

The present invention encompasses a novel information-bearing laminar assembly that would be suitable for use as or incorporated into, for example, an employee identification card, a passport, a driver's license, a voter identification card, a credit card, a bank ATM card, tickets, and other like regulated-distribution cards and documents. In the most fundamental sense, the information-bearing laminar assembly is characterized by the provision therein, as a security feature, of a graphic halftone pattern of laser-ablated microholes. Though the use of a geometric arrangement of pores in an identification card as security feature is known in the art (see e.g., U.S. Pat. No. 4,313,984), the highly-resolved embedded security images enabled by laser ablation halftoning processes described below has no apparent precedents. Such highly-resolved security images are, in addition to being more aesthetically appealing, comparatively more difficult to replicate, and hence, provides a comparatively more reliable indication of authenticity.

In particular, the information-bearing laminar assembly comprises an inner information-bearing layer interposed between a first and a second light-transmissive protective outer layer. The inner layer contains both (a) at least one of the several common types of visible information-bearing indicia found, for example, in identification cards and (b) an imagewise halftone pattern of laser-ablated microholes. The light-transmissivity of the information-bearing inner layer within said half-tone pattern can be imagewise differentiated at each microhole as a function of the microhole's penetration depth (cf, a amplitude-modulated halftoning). Alternatively, imagewise differentiation can be accomplished by imagewise varying the population of microholes in the image area (cf.,a frequency-modulated halftoning).

Sandwiched between the protective outer layers, in cooperation with the small structural dimensions of laser-ablated microholes, the halftone image will be imperceptible when the information-bearing laminar assembly is viewed in reflection and perceptible when the information-bearing laminar assembly is viewed in transmission.

Figure 1:
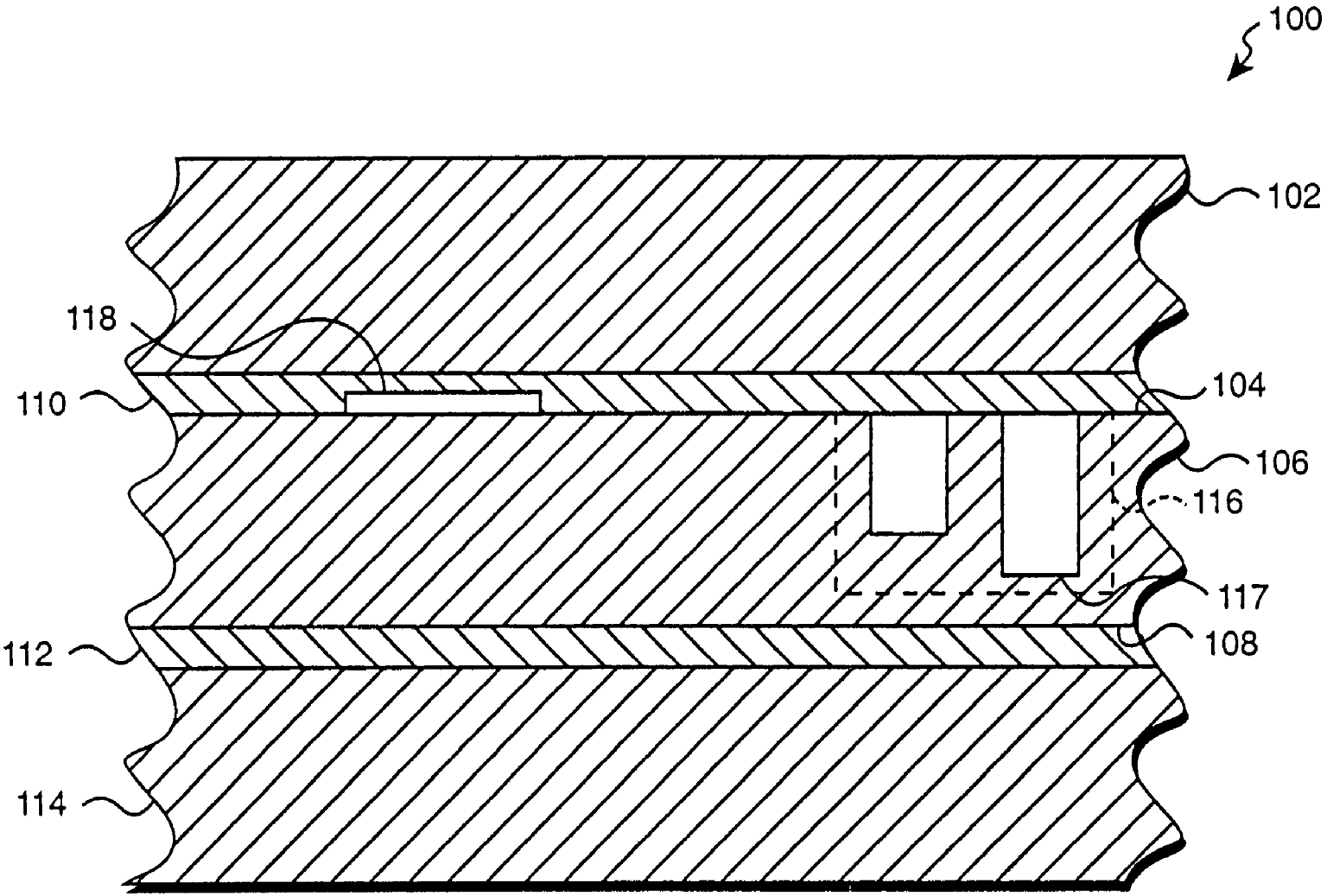
FIG. 1 is a cross-sectional schematic view of an information-bearing laminar assembly 100 according to an embodiment of the present invention.

FIG. 1 illustrates a preferred embodiment 100 of the information-bearing laminar assembly. As illustrated therein, the preferred information-bearing laminar assembly 100 comprises an inner information-bearing layer 106 having a first face 104 and a second face 108. The information-bearing inner layer is interposed between two light transmissive outer layers 102 and 114. The two light-transmissive outer layers are adhered to the inner information-bearing layer via two adhesive layers 110 and 112. The first outer light-transmissive layer 102 is adhered to the inner information-bearing layer 106 via the first adhesive layer 110 and the second outer light transmissive layer 114 is adhered to the inner information-bearing layer 106 via the second adhesive layer 112. These layers may undergo a hot lamination process as is well known in the art. Thus, a laminated structure is formed comprising the five layers described above.

The security feature 116 in the information bearing document 100 comprises a plurality of laser ablated holes on the surface of the inner information-bearing layer 106 wherein the ablated regions extend into the inner information-bearing layer a predetermined depth. The laser-ablated microholes can be of various depths to vary the density of the inner information-bearing layer and thereby vary the intensity of the light transmitted through the inner information-bearing layer.

The laser irradiation process is well suited to providing microholes of the sizes, dimensions, and depths suited for the formation of halftone patterns. As another advantage, laser ablation can be employed to provide the peripheral destructible perforations (described further below) utilizing the same devices, and at approximately time, as used in the creation of the imagewise halftone pattern of laser ablated microholes.

The most desired optical properties of security feature dictate that the inner information-bearing layer 106 be translucent and homogeneous in color throughout the depth of the material, ie., have almost no color variation. One material that fits suitably these parameters is a polymer-based synthetic paper sold by PPG Industries, Inc., under the registered trademark "TESLIN". Other rigid or semi-rigid planar material can, of course, be employed, as long such material is capable of being ablated in response to intense laser irradiation.

Preferably the outer layers 102 and 114 are substantially optically clear within the visible spectrum. A suitable material is an amorphous poly(ethylene terephthalate) (also known at "PET") sheet 34, for example, the PET sheet sold by Transilwrap, of Franklin Park, Ill. under the trade name "TXP". In general, PET has good strength and flexibility and has high anti-abrasion properties. Other suitable materials include like polyesters which are the reaction products of the polymerization of ethylene glycols with polycarboxylic acids.

It is noted that TXP can currently be purchased with an adhesive on its inside surfaces, i.e., those surfaces adjacent to the faces 104 and 108 of inner information-bearing layer 106. If however another material is selected that does not come with a precoated adhesive layer, then one may have to be provided.

For adhesive layers 102 and 114, a preferred adhesive material is KRTY, which is the commercial trade designation for an ethylene-vinyl acetate adhesive available from Transilwrap. Other heat- or pressure-activated adhesive can of course be utilized, the selection thereof depending on the nature of the processes by which the inner-information bearing layer 106 is to be coupled to the outer protective layers 102 and 114. For a heat-activated adhesive, one can employ a ethylene ethyl acrylate copolymer of an ethylene ethyl acrylate or mixture thereof.

Information 118 is illustrated in FIG. 1 provided on surface 104 of inner information-bearing layer 106. Information as used herein is defined as text or graphics that is representative of data desired to be displayed in the information bearing document. For example textual data may include, but is not limited to, the name, address, state, or privileges of the holder of the document. Graphical data may include, but is not limited to, such items as a photographic image of the holder of the information bearing document, the seal of the state or corporation issuing the document, a trademark, or other security such as a complex geometric pattern. It would be obvious to one of ordinary skill in the art that information 118 could be similarly provided on any surface on information-bearing inner layer 106 or outer layers 102 and 108. In addition, information could also be provided on either adhesive layer 110 and 112. Similarly, one of ordinary skill in the art will appreciate, in light of the teachings provided herein, that the information on certain of these surfaces would require the information to be printed a reverse format. Thus this disclosure is not intended to be limited to affixing the information in a particular orientation or to a particular surface. In addition, the information may be provided on the desired surface using any of the techniques known in the art. For example, affixing the information could include any process in which a marking material is applied to a substrate to generate a permanent mark. Thus, this term covers not only classic black and white and color printing techniques such as photogravure, flexographic and lithographic printing, but also printing by means of ink jet printers (using solid or liquid inks), laser printing, electrophotographic printing. Persons skilled in the printing art will appreciate that with some of these printing techniques, the "inks" used will not be conventional liquid inks but solid phase change inks or solid colors. This disclosure is not intended to be limited to any one means of affixing the information to a particular desired surface.

As shown in FIG. 1, the security feature 116 includes visually-perceptible information-bearing indicia and at least one imagewise halftone pattern of laser ablated microholes 117 on one or both of the surfaces 104 or 108 of information-bearing layer 106. These patterns of microholes 117 have a diameter between approximately 0.002 inches and approximately 0.004 inches and are preferably about 0.003 inches in diameter and are spaced depending upon the capability of the equipment performing the step and the complexity of the information to be included. In one embodiment in which laser ablation machining is used the center-to-center distance between adjacent patterns of microholes is 0.01 inches. In more finely-resolved halftone images, the spacing will be reduced.

The depth of the patterns of microholes 117 may be varied as a percentage of the total depth of the inner information-bearing layer 106. To accomplish this, the intensity and/or duration of the laser irradiation is modulated to imagewise differentiate the penetration depths of the laser-ablated microholes. The particular detail by which this accomplished will vary depending on the specific laser ablation equipment employed. The equipment currently employed by the inventor was obtained from Laser Machining, Inc., of Sommerset, Wis. Using such equipment, depth of microhole penetration is specifically controlled by modulating the pulse time of the laser. Whatever equipment is ultimately employed, the patterns of microholes 117 preferably should have a depth between approximately 50 percent and 100 percent of the total depth of the inner information-bearing layer 106.

As discussed above, the inner information-bearing layer 106 is a translucent material with a homogeneous color. By ablating material from security feature 116 the transmissivity of light through the inner information-bearing layer 106 can be altered without affecting the look of the information bearing document 100 when viewed in reflective light. By removing material in the pattern of microholes 1 17 through the ablation process, the density of the inner information-bearing layer 106 is changed. This allows more light to pass through the inner information-bearing layer 106 thus increasing the transmissivity of light therethrough. By varying the depth of the patterns of microholes 117, the transmissivity of each pattern of microholes can be controlled so that the intensity of light passing through the inner information-bearing layer 106 may be varied accordingly. This allows various optical effects such as half-toning including the use of gray scale variations to be utilized for security feature 116. In another embodiment (not shown) the patterns of microholes 117 may extend entirely through the inner information-bearing layer 106.

The embedded halftone imagewise pattern of laser-ablated microholes 117 of security feature 116 can be any imagewise halftone pattern of intelligence (not shown). A pattern of intelligence as used herein can be any information, either textual or graphical, that is desired to be placed on the information bearing document 100 to increase the security of the information bearing document. In one embodiment security feature 116 can be placed in area of information bearing document 100 that contains little or no other information. In a preferred embodiment, security feature 116 should be small and well hidden to further enhance the operational effectiveness of security features 116 included in information bearing document 100. In another embodiment the pattern of intelligence formed from security feature 116 can be used in cooperation with other information 118 provided on other surfaces of the information bearing document 100 to further enhance the ability of information bearing document 100 to withstand attempts at altering the information contained therein.

It will be appreciated that in the process of manufacturing the information-bearing laminar assembly 100, the microholes 117 may become filled. For example, when coupling the protective light-transmissive outer layers 102 and 114 onto the inner information-bearing layer 116 by a thermal lamination process, the brief melting of the outer layer material in combination with the compressive forces involved in such process will likely result in the flowing of said materials into said holes. Likewise, when using adhesive coatings, one should expect that adhesive materials will also likely flow into said holes, if not by coating forces, then by capillary action. As such, for purposes of the present invention, the present inventors do not wish to limit the construction of their term "microhole" to microholes that are empty. Microholes 117 filled with other material are intended.

Figure 2:
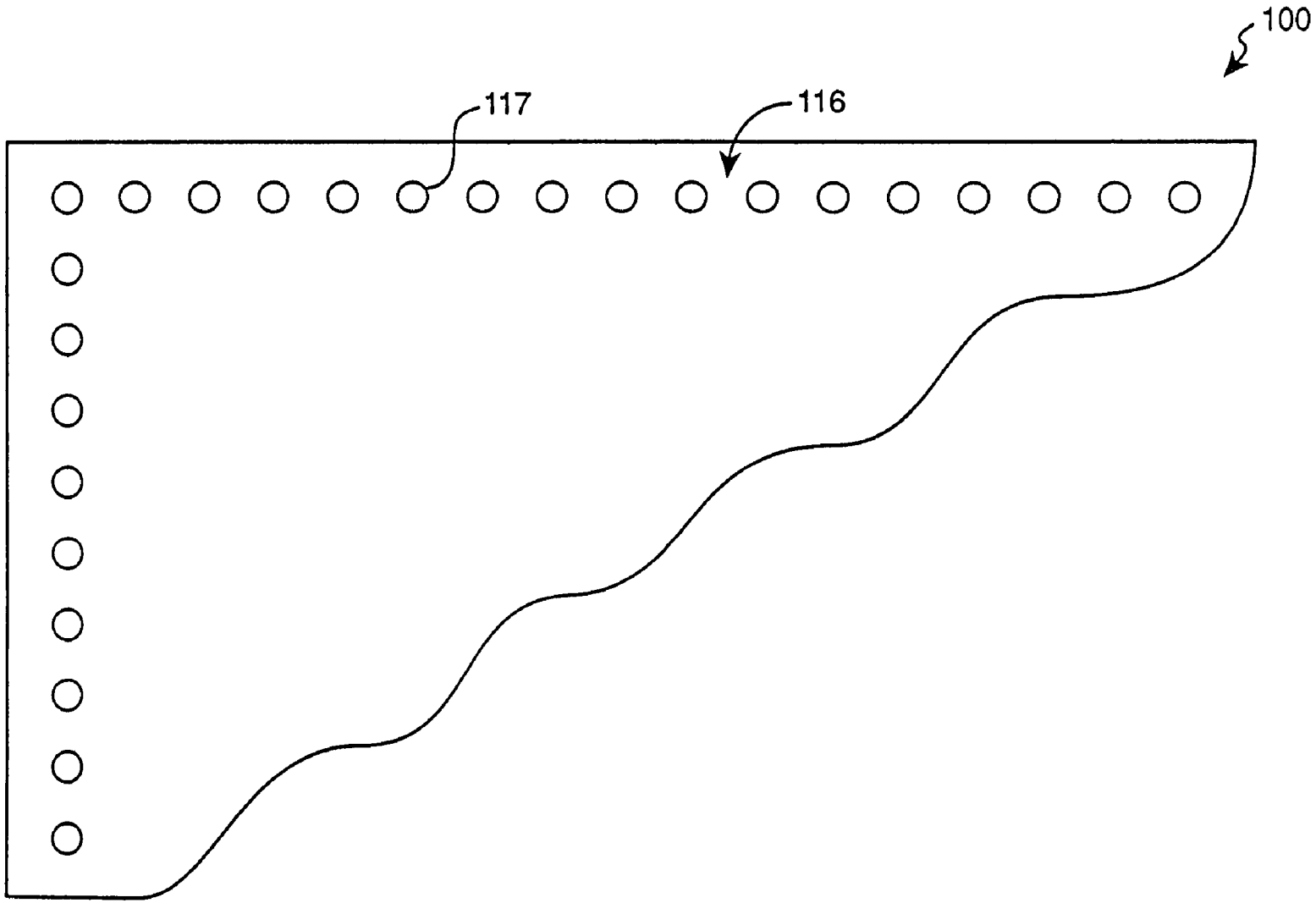
FIG. 2 is a plan view of a portion of an information-bearing laminar assembly 100 according to another embodiment of the present invention.

FIG. 2 illustrates another embodiment of security feature 116 contained within an information bearing document in which a plurality of embedded halftone imagewise patterns of laser-ablated holes 117 is disposed around the periphery of the information bearing document 100. When viewed using light that has passed through the inner information-bearing layer 106, the arrangement of such patterns of laser-ablated microholes 117 will create an identifiable optical pattern for example, a series of areas having a higher intensity light extending around the periphery of the information bearing document. The information-bearing document 100 is preferably a laminated structure as shown in FIG. 1. Any attempt to delaminate the outer polyester layers from the inner information-bearing layer will result in a disruption of the optical pattern of imagewise pattern of microholes 117 wherein a user of information bearing document 100 will be alerted to the possible alteration of information contained within information bearing document 100.

Figure 3:
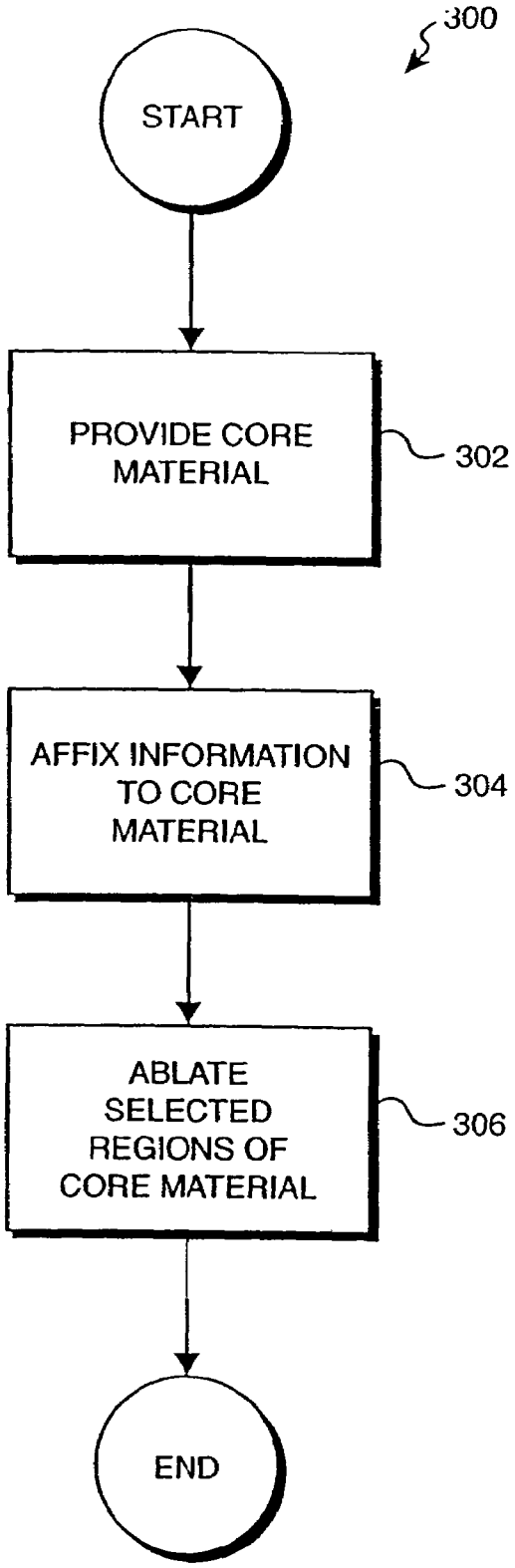
FIG. 3 is a flow chart 300 outlining certain steps performed in making an information-bearing laminar assembly 100 according to the present invention.

FIG. 3 indicates an embodiment of a method 300 for producing an information bearing document having a security feature as described above. In step 302, a laser-ablatable polymeric planar material is provided. In step 304, visually-perceptible information-bearing indicia is provided on the inner information-bearing layer as described above. The information as described above may be textual, graphical, or other pattern of intelligence that conveys the information to the proper authority. In step 306 the polymeric planar material is imagewise exposed to laser irradiation thereby providing an imagewise halftone pattern of laser-ablatable microholes on a surface of the inner-bearing information layer. The intensity and duration of the laser ablation is modulated to imagewise differentiate the penetration depths of said microholes into the polymeric planar material. It should be obvious to one of ordinary skill in the art that steps 304 and 306 may be done in any order and the invention is not limited to the order shown in FIG. 3. The actual order of affixing information to the inner information-bearing layer and ablating a surface of the information-bearing layer will be determined by the nature of the information bearing document and whether variable or fixed information is to be represented in the security feature.

While the present invention has been shown and described by reference to certain embodiments, it will be appreciated that many changes and modifications may be made therein by one skilled in the art in view of the present disclosure without departing from the essential spirit of the invention as defined in the following claims.

I claim:

1. An information-bearing assembly comprising:

a first layer, the first layer having an imagewise halftone pattern of microholes formed therein, each microhole penetrating at least partially through a thickness of the first layer such that light transmissivity of the first layer within said half-tone pattern is imagewise differentiated at each microhole; and a second layer coupled to the first layer, the second layer covering the imagewise half tone pattern of microholes in a manner that permits transmitted light to reach the microholes; wherein the second layer comprises a material that is substantially optically clear in the visible spectrum;

wherein the microholes have sufficiently small structural dimensions such that, under unassisted visual inspection, the imagewise halftone pattern is (a) substantially imperceptible when the information-bearing assembly is viewed in reflection, and (b) substantially perceptible when the information-bearing assembly is viewed in transmission.

2. The information-bearing assembly of claim 1 wherein the imagewise halftone pattern conveys at least one of fixed and variable information.

3. The information-bearing assembly of claim 1 further comprising a visually perceptible information-bearing indicium formed on at least one of the first and second layers.

4. The information-bearing assembly of claim 1 wherein the first layer comprises a material capable of having microholes formed therein by a laser.

5. The information-bearing assembly of claim 1 further comprising a layer of adhesive coupling the first and second layers together, wherein the adhesive fills at least a portion of at least one microhole.

6. The information-bearing assembly of claim 1, wherein at least a portion of the second layer fills at least a portion of at least one microhole.

7. The information-bearing assembly of claim 1, wherein the microholes are substantially empty.

8. The information-bearing assembly of claim 3, wherein at least a portion of the imagewise halftone pattern of microholes overlaps with at least a portion of the visually perceptible information-bearing indicium.

9. The information-bearing assembly of claim 3, wherein the imagewise halftone pattern cooperates with the visually perceptible information-bearing indicium to serve as a security feature for the information-bearing assembly.

10. The information-bearing assembly of claim 3, wherein the imagewise halftone pattern cooperates with the visually perceptible information-bearing indicium to help the information-bearing assembly to withstand attempted alteration.

11. An information-bearing assembly comprising:

a first layer, the first layer having an imagewise halftone pattern of microholes formed therein, each microhole penetrating at least partially through a thickness of the first layer such that light transmissivity of the first layer within said half-tone pattern is imagewise differentiated at each microhole; and a second layer coupled to the first layer, the second layer covering the imagewise half tone pattern of microholes in a manner that permits transmitted light to reach the microholes;

wherein the microholes have sufficiently small structural dimensions such that, under unassisted visual inspection, the imagewise halftone pattern is (a) substantially imperceptible when the information-bearing assembly is viewed in reflection, and (b) substantially perceptible when the information-bearing assembly is viewed in transmission wherein the imagewise halftone pattern comprises a gray scale pattern.

12. The information-bearing assembly of claim 11 wherein the imagewise halftone pattern comprises a gray scale pattern of at least one of fixed and variable information.

13. An information-bearing assembly comprising:

a first layer, the first layer having an imagewise halftone pattern of microholes formed therein, each microhole penetrating at least partially through a thickness of the first layer such that light transmissivity of the first layer within said half-tone pattern is imagewise differentiated at each microhole; and a second layer coupled to the first layer, the second layer covering the imagewise half tone pattern of microholes in a manner that permits transmitted light to reach the microholes;

wherein the microholes have sufficiently small structural dimensions such that, under unassisted visual inspection, the imagewise halftone pattern is (a) substantially imperceptible when the information-bearing assembly is viewed in reflection, and (b) substantially perceptible when the information-bearing assembly is viewed in transmission; wherein the imagewise halftone pattern is constructed and arranged such that an attempt to decouple the first and second layers results in a disruption of the imagewise halftone pattern.

14. The information-bearing assembly of claim 13, wherein the disruption is such that a user of the information-bearing assembly will be alerted to such disruption.

15. An information-bearing assembly comprising;

a first layer, the first layer having an imagewise halftone pattern of microholes formed therein, each microhole penetrating at least partially through a thickness of the first layer such that light transmissivity of the first layer within said half-tone pattern is imagewise differentiated at each microhole; and a second layer coupled to the first layer, the second layer covering the imagewise half tone pattern of microholes in a manner that permits transmitted light to reach the microholes;

wherein the microholes have sufficiently small structural dimensions such that, under unassisted visual inspection, the imagewise halftone pattern is (a) substantially imperceptible when the information-bearing assembly is viewed in reflection, and (b) substantially perceptible when the information-bearing assembly is viewed in transmission wherein the second layer comprises at least one of amorphous polyethylene terephthalate (PET), polyester, and a polyester that is the reaction product of the polymerization of ethylene glycols with polycarboxylic acid.

16. A method of manufacturing an information-bearing assembly comprising:

providing a first layer comprising material capable of having microholes formed therein;

forming in said planar material an imagewise halftone pattern of microholes, the microholes having sufficiently small structural dimensions such that under unassisted visual inspection, the halftone pattern is substantially imperceptible when the information-bearing laminar assembly is viewed in reflection and substantially perceptible when the information-bearing laminar assembly is viewed in transmission, wherein the imagewise halftone pattern comprises at least one of fixed and variable data; and coupling a second layer to the first layer, the second layer covering the imagewise half tone pattern of microholes in a manner that permits transmitted light to reach the microholes.

17. The method of claim 16, further comprising forming a visually perceptible information-bearing indicium formed on the first layer.

18. The method of claim 16, further comprising forming a visually perceptible information-bearing indicium formed on the first layer.

19. The method of claim 16 wherein the microholes are formed such that an attempt to decouple the second layer from the first layer results in a disruption of the imagewise halftone pattern.

20. The method of claim 17, further comprising selecting and arranging the imagewise halftone pattern of microholes such the imagewise halftone pattern of microholes cooperates with the visually perceptible information-bearing indicium to help the information-bearing assembly to withstand attempted alteration.

21. The method of claim 17, further comprising selecting and arranging the visually perceptible information-bearing indicium such that the visually perceptible information-bearing indicium cooperates with the imagewise halftone pattern of microholes to help the information-bearing assembly to withstand attempted alteration.

22. The method of claim 17, wherein the visually perceptible information is formed on the first layer before the imagewise halftone pattern of microholes is formed on the first layer.

23. The method of claim 18, further comprising selecting and arranging the imagewise halftone pattern of microholes such the imagewise halftone pattern of microholes cooperates with the visually perceptible information-bearing indicium to help the information-bearing assembly to withstand attempted alteration.

24. The method of claim 18, further comprising selecting and arranging the visually perceptible information-bearing indicium such that the visually perceptible information-bearing indicium cooperates with the imagewise halftone pattern of microholes to help the information-bearing assembly to withstand attempted alteration.

25. A method of manufacturing an information-bearing assembly comprising:

providing a first layer comprising material capable of having microholes formed therein;

forming a visually perceptible information-bearing indicium formed on the first layer; and forming in said planar material an imagewise halftone pattern of microholes, the microholes having sufficiently small structural dimensions such that under unassisted visual inspection, the halftone pattern is substantially imperceptible when the information-bearing laminar assembly is viewed in reflection and substantially perceptible when the information-bearing laminar assembly is viewed in transmission, wherein the imagewise halftone pattern comprises at least one of fixed and variable data wherein the visually perceptible information is formed on the first layer after the imagewise halftone pattern of microholes is formed on the first layer.

26. The method of claim 17, further comprising selecting and arranging the visually perceptible information-bearing indicium and the imagewise halftone pattern of microholes such that at least a portion of the imagewise halftone pattern of microholes overlaps with at least a portion of the visually perceptible information-bearing indicium.

27. A method of manufacturing an information-bearing assembly comprising:

providing a first layer comprising material capable of having microholes formed therein; and forming in said planar material an imagewise halftone pattern of microholes, the microholes having sufficiently small structural dimensions such that under unassisted visual inspection, the halftone pattern is substantially imperceptible when the information-bearing laminar assembly is viewed in reflection and substantially perceptible when the information-bearing laminar assembly is viewed in transmission, wherein the imagewise halftone pattern comprises at least one of fixed and variable data; wherein the imagewise halftone pattern comprises a gray scale pattern.

28. An identification document, comprising:

an information-bearing layer having a visually perceptible indicium formed thereon;

means for providing an imagewise halftone pattern of microholes within the identification document, the microholes being substantially imperceptible when the identification document is viewed in reflection, and substantially perceptible when light is transmitted through the identification document: and means for disrupting the imagewise halftone pattern of microholes if an attempt is made to alter the identification document.

29. An identification document, comprising:

an information-bearing layer having a visually perceptible indicium formed thereon:

means for providing an imagewise halftone pattern of microholes within the identification document, the microholes being substantially imperceptible when the identification document is viewed in reflection, and substantially perceptible when light is transmitted through the identification document; and means for associating the imagewise halftone pattern of microholes with the visually perceptible indicium.

30. The identification document of claim 29, wherein the association between the imagewise halftone pattern of microholes and the visually perceptible indicium acts as a security feature for the identification document.

* * * * *